US010004377B2

(12) United States Patent
Haltmayer et al.

(10) Patent No.: US 10,004,377 B2
(45) Date of Patent: Jun. 26, 2018

(54) DISHWASHER

(75) Inventors: Werner Haltmayer, Dinkelsbühl (DE); Mathias Herrmann, Nattheim (DE); Stefan Kasbauer, Dillingen (DE); Claus Köther, Bächingen (DE); Martin Weissenburger, Bissingen (DE); Mark Woldenberg, Bachhagel (DE)

(73) Assignee: BSH Hausgeräte GmbH, Munich (DE)

( * ) Notice: Subject to any disclaimer, the term of this patent is extended or adjusted under 35 U.S.C. 154(b) by 1546 days.

(21) Appl. No.: 13/354,359

(22) Filed: Jan. 20, 2012

(65) Prior Publication Data

US 2012/0186609 A1 Jul. 26, 2012

(30) Foreign Application Priority Data

Jan. 21, 2011 (DE) ..... 10 2011 002 989

(51) Int. Cl.
*A47L 15/42* (2006.01)

(52) U.S. Cl.
CPC ..... *A47L 15/4208* (2013.01); *A47L 15/4202* (2013.01); *A47L 15/4246* (2013.01); *A47L 15/4204* (2013.01); *A47L 15/4206* (2013.01)

(58) Field of Classification Search
CPC ..... A47L 15/4204; A47L 15/4208; A47L 15/4202; A47L 15/4206; A47L 15/4246
USPC ..... 134/56 D, 57 D, 58 D, 104.1, 109–111
See application file for complete search history.

(56) References Cited

U.S. PATENT DOCUMENTS

| | | | | |
|---|---|---|---|---|
| 4,972,861 | A | 11/1990 | Milocco et al. | |
| 2006/0054201 | A1* | 3/2006 | Yoon et al. | 134/56 D |
| 2006/0130878 | A1* | 6/2006 | Lee et al. | 134/18 |
| 2006/0237049 | A1* | 10/2006 | Weaver et al. | 134/56 D |
| 2007/0163626 | A1* | 7/2007 | Klein | A47L 15/0049 134/56 D |
| 2011/0226289 | A1* | 9/2011 | Forster | A47L 15/4204 134/111 |

FOREIGN PATENT DOCUMENTS

| | | | |
|---|---|---|---|
| DE | 1428358 | A1 | 11/1968 |
| DE | 3745169 | C2 | 7/1999 |
| EP | 1386575 | A1 | 2/2004 |
| GB | 2096456 | A | 10/1982 |

OTHER PUBLICATIONS

National Search Report EP 12 15 0074 dated Sep. 14, 2017.

* cited by examiner

*Primary Examiner* — Levon J Shahinian
(74) *Attorney, Agent, or Firm* — Michael E. Tschupp; Andre Pallapies; Brandon G. Braun

(57) ABSTRACT

A dishwasher, in particular a household dishwasher, includes a circulation pump for circulating a washing liquid in a hydraulic circuit. Connected to an induction side of the circulation pump is a pump sump through which washing liquid flows. The sump pump includes at least one filter element that retains dirt particles contained in the washing liquid and can be cleaned by at least one cleaning device provided in the pump sump.

25 Claims, 4 Drawing Sheets

DISHWASHER

BACKGROUND OF THE INVENTION

The invention relates to a dishwasher, in particular a household dishwasher.

Dishwashers have filter systems, by means of which dirt particles can be filtered out of the washing liquid that circulates in a hydraulic circuit of the dishwasher. The filter systems generally have more than one stage and consist of a flat fine filter, a coarse filter and optionally a microfilter. Corresponding to their designations, these filters can filter out dirt particles of different sizes from the washing liquid.

For example, DE 31 14 663 A1 discloses a dishwasher that has a hydraulic circuit in which washing liquid circulates and collects in a pump sump at the bottom, wherein said pump sump is attached to the induction side of the circulation pump. The open side of the pump sump, said side being oriented towards the dishwasher interior, is covered by a flat filter which tapers in the form of a funnel towards a hollow cylindrical coarse filter that is arranged approximately centrally. This coarse filter leads to a likewise hollow cylindrical microfilter beneath the flat filter, said microfilter being surrounded at a distance by a sump wall of the pump sump.

The filter system consisting of the flat filter, the coarse filter and the microfilter becomes dirty over time, meaning that the flat filter, the coarse filter and/or the microfilter can become clogged with food residues or other particles that are deposited thereon. Clogged filter surfaces adversely affect the washing results, primarily due to resoiling and reduced filter performance. In some cases, the lower spray arm under the rack can already feature nozzles that are directed at the flat filter beneath them. However, it is not possible to rinse the flat filter completely clean in this way.

BRIEF SUMMARY OF THE INVENTION

The invention therefore addresses the problem of providing a dishwasher, in particular a household dishwasher, in which the filter performance of the filter combination used in the dishwasher is not adversely affected, even in continuous use.

The problem is solved by the features in claim 1. Preferred developments of the invention are disclosed in the subclaims.

The invention is based on the finding that dirt particles of a certain size and composition, e.g. caraway seeds and the like, cannot be removed from the filter surface by spraying the filter surface of the flat filter by means of spray nozzles that are provided on the underside of the lower spray arm, but are instead pressed further into the filter openings and therefore become compacted therein. In this context, provision is made in the characterizing part of claim 1 for at least one cleaning device within the pump sump, by means of which the filter element can be cleaned. The cleaning of the filter element does not therefore take place on the filter surface that is clogged by food residues, but on the opposite side of the filter element, whereby the filter element can be rinsed clean in the opposite flow direction to that established during the washing operation.

The pump sump of a dishwasher can preferably feature a filter combination comprising the above cited flat filter, a coarse filter and a microfilter. The flat filter can cover that side of the pump sump which is open to the dishwasher interior, and taper in the form of a funnel towards the hollow cylindrical coarse filter that is arranged approximately centrally in the flat filter. The coarse filter can extend beneath the flat filter in the form of the microfilter, which is likewise of hollow cylindrical design. The coarse filter is used in this case to filter out larger dirt particles, while the fine filter and the microfilter are used to filter out dirt particles that are finely dispersed in the washing liquid. Using an appropriate filter combination of this type, the inventive cleaning device is therefore so arranged in the pump sump that it is physically separated from the dishwasher interior by the flat filter. The cleaning device can therefore firstly remove filter residues on the flat filter from its underside, i.e. from the opposite side to the filter surface, while the cleaning device can optionally also clean the microfilter which is arranged within the pump sump. In this case, the cleaning device can be arranged radially outside the hollow cylindrical microfilter or alternatively radially inside the microfilter, in which case it can clean the liquid outflow side of the microfilter, said liquid outflow side being oriented away from the filter surface.

According to an advantageous embodiment, the cleaning device can have at least one spray nozzle, in particular a multiplicity of spray nozzles, which can mechanically spray the filter element by means of liquid jets. In this way, short powerful bursts of spray can be directed at the filter element, in order to rinse the filter element clean of dirt that has adhered. In this case, the effective direction of these spray nozzles is counter to the usual flow direction of the washing liquid during the washing operation. The spray nozzles can easily be connected to the original hydraulic circuit of the dishwasher via at least one connection line. In the hydraulic circuit, one or more feed lines can lead from the circulation pump to the spray devices that are arranged in the dishwasher interior, i.e. in particular to an upper spray arm which is arranged below the upper rack or to a lower spray arm which is arranged below a lower rack. From there, the washing liquid is sprayed onto the items to be washed in the dishwasher interior. The washing liquid then collects again in the pump sump, which is connected to the induction side of the circulation pump.

The cleaning device can preferably have at least one distributor pipeline which comprises a series of spray nozzles and is connected via the connection line to the above described hydraulic circuit of the dishwasher. In this case, the washing liquid that circulates in the hydraulic circuit can immediately be used at least partly for the filter cleaning according to the invention. A water switch can preferably be provided for control purposes at the branch point between the one or more feed lines and the connection line leading to the cleaning device, wherein said water switch opens or closes a flow path to the spray devices in the spraying zone and/or to the connection line, depending on the switch position. By preference, however, only the connection line to the cleaning device is open during the cleaning process, while the liquid paths to the spray arms are interrupted, such that the washing liquid can be conveyed to the cleaning device at a particularly high hydraulic pressure.

The cleaning device can be activated e.g. automatically by the control electronics of the dishwasher, preferably e.g. at the start of a wash cycle during the prewash stage or the cleaning stage, during which the majority of food residues are removed by the washing liquid. Alternatively or additionally, the cleaning device can also be activated by manual operation of a control element by the user.

The spray nozzles of the distributor pipeline can be directed e.g. at the underside of the flat filter and/or at the microfilter that is arranged in the pump sump. In this case, the distributor pipeline can extend essentially annularly around the microfilter in the circular space that is provided in the pump sump.

As mentioned above, the circular space can be delimited in a vertical direction by the flat filter above, and by a correspondingly designed base flange of the pump sump below. Depending on the geometry of the pump sump, the base flange can essentially extend radially outwards from a hollow cylindrical sump wall that surrounds the microfilter, and optionally merge at its periphery into an upwardly projecting annular collar, which can be covered e.g. by the peripheral region of the opening of the base tray of the washing compartment. Furthermore, the base flange of the pump sump can feature one or more fastening means, preferably catch elements, whereby the distributor pipeline can easily be fixed via catch means to the pump sump in a detachable manner.

Alternatively and/or additionally to the distributor pipeline mentioned above, the cleaning device can feature any type of cleaning body by means of which filter residues can be removed from the filter element. For example, such a cleaning body can be a scraper, by means of which the filter residues can be scraped off the filter element. Alternatively, provision can be made for cleaning bodies which can move freely within the circular space of the pump sump. In this case, the cleaning bodies can be moved by the circular liquid flow in the circular space, thereby removing filter residues from the filter element. According to the invention, the cleaning bodies can move in particular transversely along the underside of the flat filter in the circular space.

The forms and developments of the invention as set forth above and/or as described in the subclaims can be used individually or in any desired combination, except in the case of clear dependencies and incompatible alternatives, for example.

BRIEF DESCRIPTION OF THE DRAWINGS

The invention and its advantageous forms and developments are explained with their advantages in greater detail below with reference to drawings, in which.

DETAILED DESCRIPTION OF EXEMPLARY EMBODIMENTS OF THE PRESENT INVENTION

Figure 1:
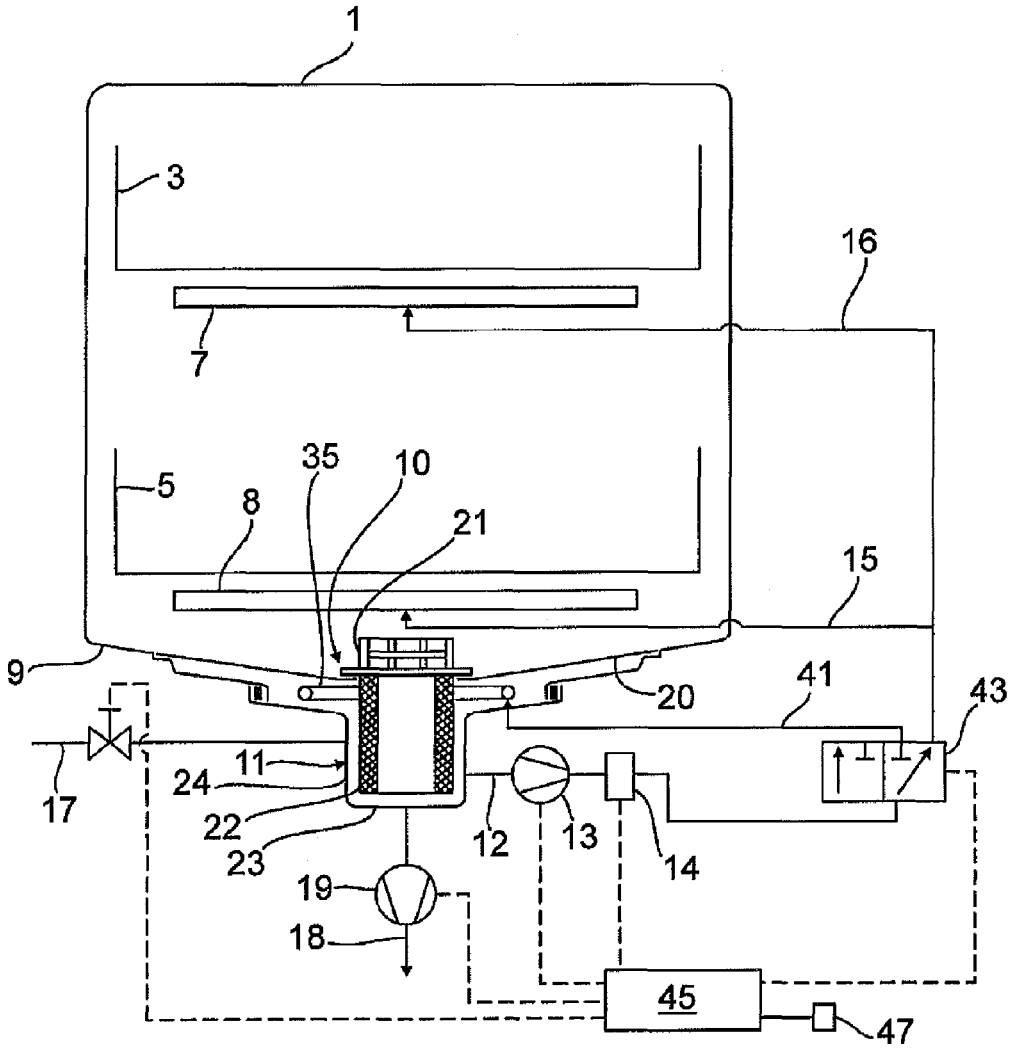
FIG. 1 shows a block schematic diagram of the flow paths in the hydraulic circuit of the dishwasher.

FIG. 1 schematically shows a dishwasher comprising a washing compartment 1 which delimits a dishwasher interior. Upper and lower racks 3, 5 are arranged in the dishwasher interior of the washing compartment 1. Spray arms 7, 8, which spray the items to be washed with washing liquid, are arranged at different spray levels below the two racks 3, 5 respectively. Furthermore, a pump sump 11 containing filter arrangement 10 is provided in the washing compartment floor 9, and filters out food remains of different sizes from the circulating washing liquid during the washing operation. A circulation line 12, in which a circulation pump 13 and a subsequent water heater 14 are arranged, leads away from an outlet stud (not shown) of the pump sump 11. The flow in the circulation line 12 is connected via feed lines 15, 16 to the spray arms 7, 8. The pump sump 11 is connected via further connection studs to a fresh water feed line 17 (this being linked to the water supply network) and to a discharge line 18, in which a drain pump 19 for pumping washing liquid out of the washing compartment 1 is arranged.

Figure 3:
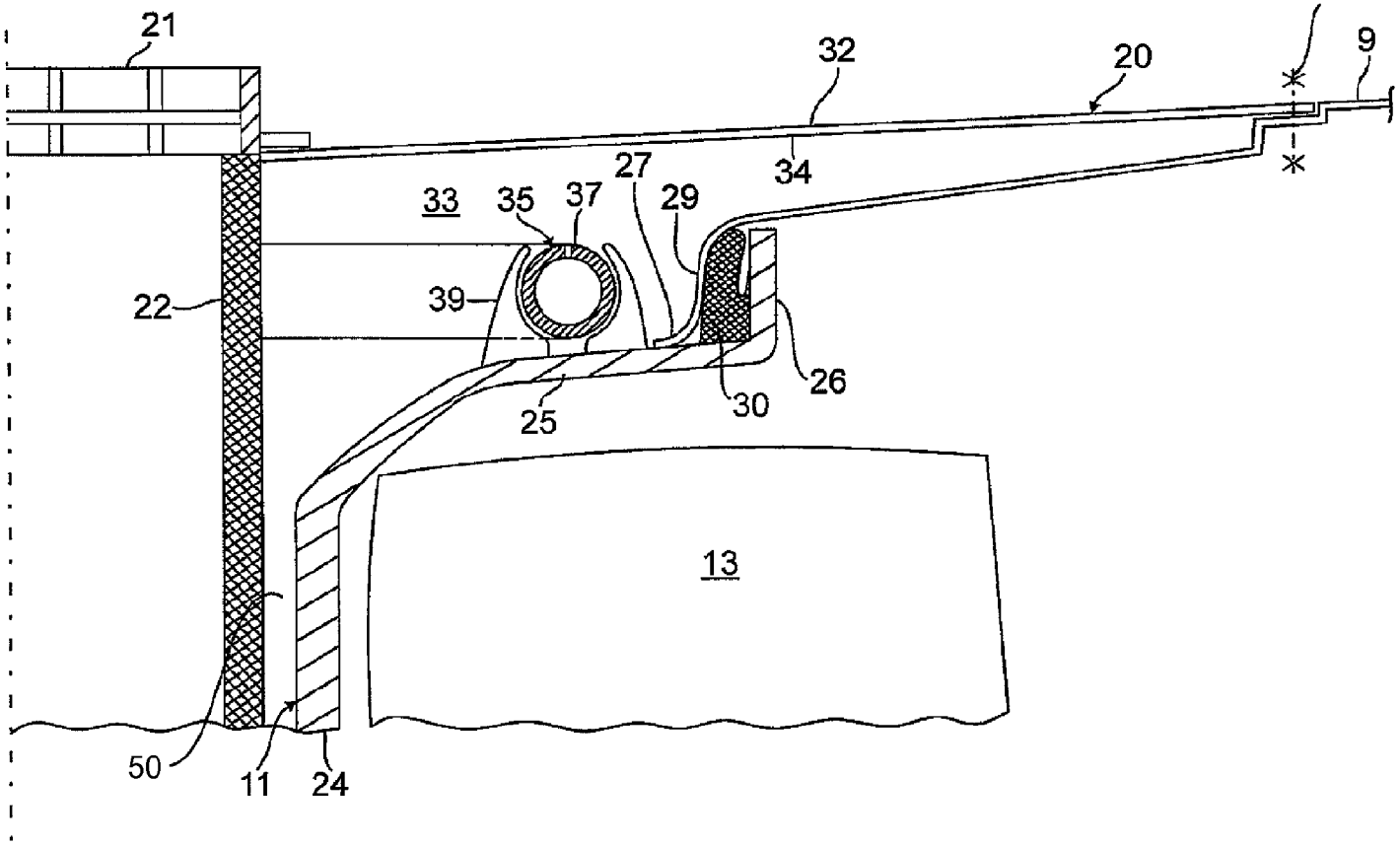
FIG. 3 shows a magnified sectional view of the pump sump region of the dishwasher.

It is clear from FIG. 1 that the filter arrangement 10 in the pump sump 11 features a flat filter 20, a coarse filter 21 and a micro filter 22. In this case, the flat filter 20 covers that side of the pump sump 11 which is open towards the dishwasher interior above, and lies approximately flush in the floor 9 of the washing compartment as shown in FIG. 1. The flat filter 20 is usually a metal grid, which runs in the form of a funnel towards the coarse filter 21 that is located in the center of the flat filter 20. The coarse filter 21 is embodied as a hollow cylinder having a coarse-mesh grid, and projects above the surface 32 (FIG. 3) of the flat filter 20. Moreover, the coarse filter 21 extends vertically downwards in the form of the microfilter 22, which is likewise designed in the form of a hollow cylinder and itself extends to the very floor 23 of the pump sump 11. By way of example, the pump sump 11 is illustrated in the figures as a rotationally symmetrical hollow body comprising the pump sump floor 23 and a cylindrical sump wall 24 rising therefrom. The sump wall 24 surrounds the microfilter 22 leaving a flow gap 50, and in its axial course upwards merges as per FIG. 3 into a circumferential base flange 25 which is curved outwards laterally. At the radially outer end of the base flange 25, an upwardly projecting annular collar 26 is attached as shown in FIG. 3. The pump sump 11 thus designed is mounted from below onto a correspondingly designed peripheral region of the opening of the washing compartment floor 9 as shown in FIG. 3. The peripheral region of the opening is stepped in a downwards direction by means of an inner peripheral flange 27, which can be connected to the base flange 25 of the pump sump 11 by means of screws, for example. A continuous seal 30 is inserted between an annular shoulder 29 of this step and the radially outer annular collar 26 of the pump sump.

Figure 2:
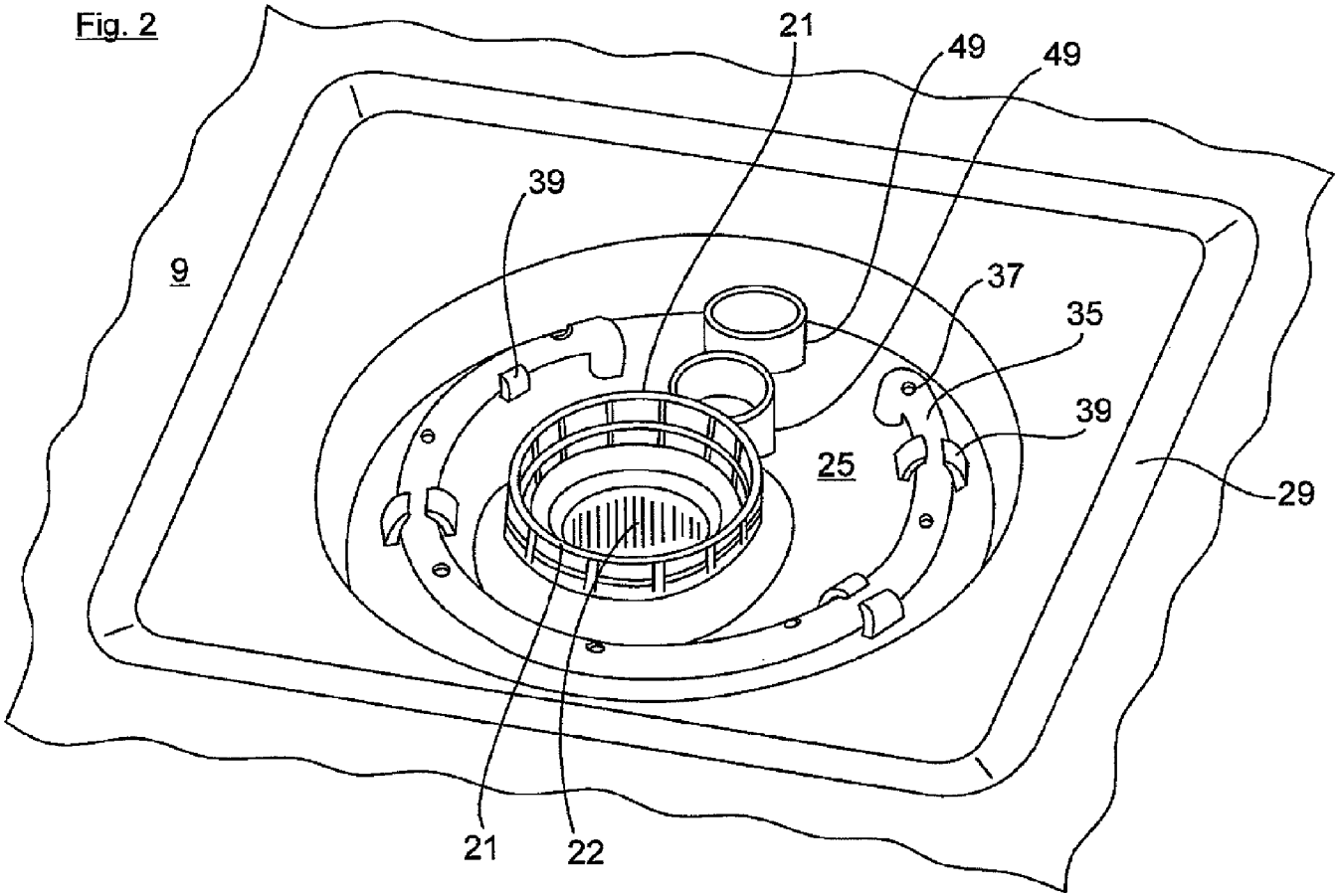
FIG. 2 shows a view from above of a base tray of a washing compartment and a pump sump which is integrated therein, wherein a flat filter has been removed.

It is moreover clear from FIG. 3 that the flat filter 20 is fastened to the washing compartment floor 9 at its outer periphery by means of screw connections 31, for example. This results in a free circular space 33 between the flat filter 20 and the base flange 25 of the pump sump 11, wherein said space extends radially around the hollow cylindrical microfilter 22. A circular flow is established in the circular space 33 during the washing operation, and flows transversely along the underside 34 of the flat filter 20. A distributor pipeline 35 featuring upward pointing spray nozzles 37 is additionally arranged as an inventive cleaning device in the circular space 33 below the flat filter 20. As shown in FIG. 2, the distributor pipeline 35 extends almost annularly around the circular space 33 and is only interrupted by a small segment of the circle in order to provide structural space for the connection studs 49 that are formed in the base flange 25 and are part of the feed lines 15, 16 leading to the upper and lower spray arms 7, 8. As shown in FIGS. 2 and 3, provision is further made on the base flange 25 of the pump sump 11 for catch limbs 39, which are separated from each other in a radial direction by a retaining gap and between which the distributor pipeline 35 is arrested. The distributor pipeline 35 can therefore be installed in a detachable manner between the catch limbs 39 from above during assembly.

In FIG. 1, the distributor pipeline 35 is connected via a connection line 41 to the hydraulic circuit of the dishwasher. A water switch 43, which is represented in the block schematic diagram in FIG. 1 simply as a 3/2-way valve, is arranged for this purpose at a branch point between the feed lines 15, 16 and the connection line 41. The liquid path to the distributor pipeline 35 and/or to the feed lines 15, 16 is open or closed according to the switch position of this water switch 43.

FIG. 1 also shows the control unit 45, which has a signal connection to the device components in the hydraulic circuit. In the exemplary embodiment here, the control electronics 45 also comprise a control element 47 which can be operated manually by the user and whose operation causes the control electronics to activate a cleaning mode, during which the washing liquid can be selectively fed through the connection line 41 to the distributor pipeline 35 in order to direct short powerful bursts of spray onto the underside of the flat filter 20, for example. Provision can be made alternatively and/or additionally for further spray nozzles (not shown), which are directed at the filter surface of the microfilter 22.

In addition to or independently of the manually controlled activation, the cleaning mode can also be activated automatically by means of the control electronics 45 during a wash cycle. For this purpose, the cleaning mode can be activated in particular at the start of the wash cycle, e.g. in a prewash stage or in a washing stage, in order to rinse the flat filter 20 clean from a direction that is opposite to the normal flow direction. Alternatively or additionally, the filter cleaning according to the invention can obviously be done after completion of the respective wash cycle or before starting the wash cycle of a new dishwashing program, i.e. between two consecutive dishwashing programs.

Figure 4:
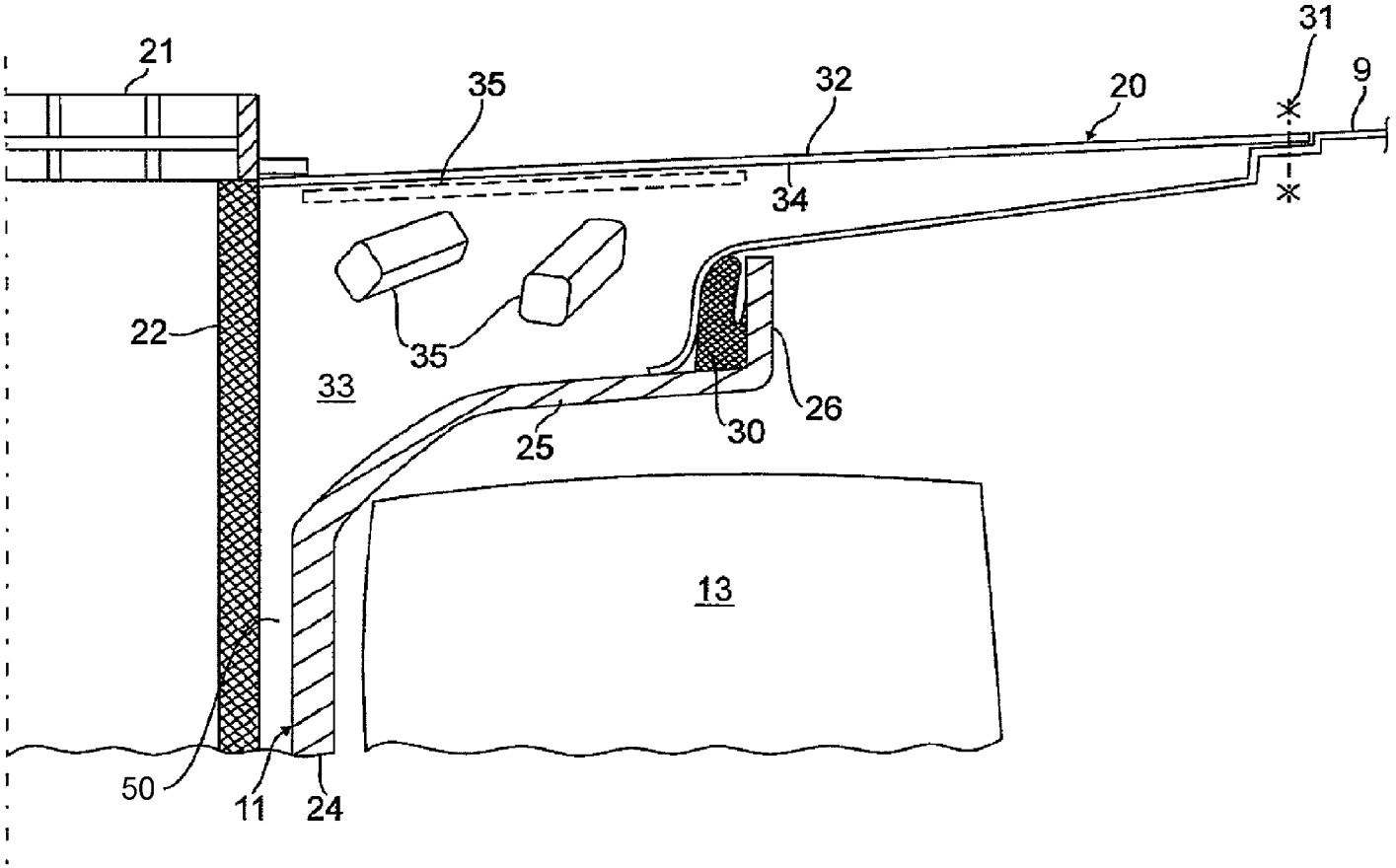
FIG. 4 shows a further embodiment of the invention in a view corresponding to FIG. 2.

In the embodiment shown in FIG. 4, the cleaning device 35 does not have a distributor pipeline, but has cleaning bodies that are arranged movably in the circular space 33. As indicated in FIG. 4, the cleaning bodies 35 move freely in the circular flow that is established in the circular space 33 during the wash cycle, and therefore also strike against the underside 34 of the flat filter 20, whereby filter residues that have settled in the filter openings can be removed from the underside 34 of the flat filter 20. Alternatively and/or additionally, the cleaning device 35 can also be embodied as a scraper as indicated by the broken line in FIG. 4. The scraper can move along a circular path around the outside of the microfilter 22, for example, and scrape the underside 34 of the flat filter 20 in this case, thereby allowing the filter residues that have settled to be removed.

If applicable, the filter cleaning by means of such scrapers can also be effective in connection with a distributor pipeline as explained with reference to the FIGS. 1 to 3 above.

What is claimed is:

1. A dishwasher, comprising:

a washing compartment with a bottom surface;

a circulation pump configured to circulate a washing liquid in a hydraulic circuit, said circulation pump having an induction side;

a pump sump adjacent the bottom surface of the washing compartment and which is connected to the induction side of the circulation pump and through which is configured to flow washing liquid there through, said pump sump including a first filter element and a second filter element that are each configured to retain dirt particles contained in the washing liquid, wherein the first filter element forms part of the bottom surface, the first filter element includes a hole through the first filter element, and the second filter element is tube-shaped with an open end aligned with the hole so that the washing liquid can flow from the washing compartment into the open end and downwards through a central passage of the second filter element and can flow radially outwards from the central passage to be filtered through the second filter element; and a cleaning device provided in the pump sump and configured to clean the first filter element and the second filter element.

2. The dishwasher of claim 1, constructed in the form of a household dishwasher.

3. The dishwasher of claim 1, said first filter element being a flat filter which is configured in at least one of two ways: a first way in which the first filter element covers said induction side of the pump sump, and a second way in which the first filter element separates the cleaning device from the washing compartment.

4. The dishwasher of claim 1, wherein the first filter element has a filter surface and a liquid outflow side which is opposite to the filter surface, said cleaning device being constructed to spray the liquid outflow side to remove filter residues.

5. The dishwasher of claim 4, wherein the liquid outflow side is an underside of first filter element, said underside facing away from the washing compartment.

6. The dishwasher of claim 1, wherein the cleaning device includes a spray nozzle generating liquid jets to spray the second filter element.

7. The dishwasher of claim 6, wherein the cleaning device includes a multiplicity of said spray nozzle.

8. The dishwasher of claim 1, wherein the cleaning device includes at least one cleaning body to remove filter residues from the first filter element.

9. The dishwasher of claim 8, wherein the at least one cleaning body is a scraper.

10. The dishwasher of claim 1, wherein the second filter element includes a coarse filter and a microfilter, the coarse filter being above the microfilter.

11. The dishwasher of claim 10, wherein the pump sump has a free circular space in which the cleaning device is arranged and the free circular space is provided around the second filter element.

12. The dishwasher of claim 11, wherein the circular space is delimited in a vertical direction by the first filter element and by a base flange of the pump sump.

13. The dishwasher of claim 1, wherein the cleaning device is connected to the hydraulic circuit by a connection line.

14. The dishwasher of claim 13, wherein the connection line branches off from a feed line that carries the washing liquid from the circulation pump to one or more spray devices which are arranged in a dishwasher interior.

15. The dishwasher of claim 14, further comprising a water switch provided at a branch point between the feed line and the connection line, said water switch opening or closing a flow path to at least one of the feed line and the connection line depending on a switch position.

16. The dishwasher of claim 1, further comprising a control element actuated by a user to manually activate the cleaning device.

17. The dishwasher of claim 1, further comprising a control electronics configured to automatically activate the cleaning device.

18. The dishwasher of claim 1, wherein the cleaning device is fixed to the pump sump via at least one fastener.

19. The dishwasher of claim 18, wherein the at least one fastener is configured as a catch element provided on a base flange of the pump sump.

20. The dishwasher of claim 19, wherein the catch element is configured to detachably connect the cleaning device to the pump sump.

21. The dishwasher of claim 1, wherein the first filter element and the second filter element are located to filter the washing liquid as the washing liquid flows away from a dishwasher interior and towards the induction side.

22. The dishwasher of claim 1, wherein the second filter element has an upstream side and a downstream side, the upstream side is a side that the washing liquid enters into the second filter element as a result of the washing liquid being drawn into the induction side of the circulation pump, the downstream side is opposite the upstream side and the downstream side faces the cleaning device.

23. The dishwasher of claim 1, wherein the pump sump has a side which is open to a dishwasher interior, said first filter element being flat, the second filter element comprises a coarse filter and a microfilter, said second filter element being attached to the first filter element and wherein the pump sump has a free circular space in which the cleaning device is arranged and the free circular space and the cleaning device are disposed around an outer periphery of the second filter element.

24. The dishwasher of claim 1, wherein the second filter element has a filter surface and a liquid outflow side which is opposite to the filter surface, said cleaning device being constructed to spray the liquid outflow side to remove filter residues.

25. The dishwasher of claim 24, wherein the liquid outflow side faces away from the central passage.

* * * * *